US007866660B2

(12) United States Patent
Ishida

(10) Patent No.: US 7,866,660 B2
(45) Date of Patent: Jan. 11, 2011

(54) SHEET STORING DEVICE AND IMAGE FORMING APPARATUS PROVIDED THEREWITH

(75) Inventor: Yujiro Ishida, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 453 days.

(21) Appl. No.: 11/651,201

(22) Filed: Jan. 9, 2007

(65) Prior Publication Data

US 2007/0290434 A1 Dec. 20, 2007

(30) Foreign Application Priority Data

Jun. 19, 2006 (JP) ..... 2006-168450

(51) Int. Cl.
*B65H 1/00* (2006.01)

(52) U.S. Cl. ..... 271/171; 271/253; 271/226

(58) Field of Classification Search ..... 271/238, 271/240, 171, 226, 234
See application file for complete search history.

(56) References Cited

U.S. PATENT DOCUMENTS 2,938,723 A * 5/1960 Paulson ..... 271/240
4,637,602 A * 1/1987 Gavaghan et al. ..... 271/238
4,772,007 A * 9/1988 Kashimura ..... 271/22
5,091,754 A * 2/1992 Abe et al. ..... 399/394
5,152,622 A * 10/1992 Rasmussen et al. ..... 400/579
5,154,413 A * 10/1992 Boughton et al. ..... 271/248
5,209,467 A * 5/1993 Schmaling ..... 271/240
5,286,018 A * 2/1994 Rasmussen et al. ..... 271/147
5,462,374 A * 10/1995 Kohno ..... 400/625
5,536,000 A * 7/1996 Kelly ..... 271/189
5,540,370 A * 7/1996 Ring ..... 225/100
5,595,380 A * 1/1997 McCue et al. ..... 271/9.09
5,685,533 A * 11/1997 Hartsoe ..... 271/11
6,364,553 B1 * 4/2002 McCue et al. ..... 400/625
6,367,794 B1 * 4/2002 Godwin et al. ..... 270/58.26
6,406,201 B1 * 6/2002 Beretta et al. ..... 400/605
6,659,667 B2 * 12/2003 McCue et al. ..... 400/625
6,728,509 B2 * 4/2004 Cornelius ..... 399/393

(Continued)

FOREIGN PATENT DOCUMENTS

JP 2002-347956 A 12/2002

(Continued)

OTHER PUBLICATIONS

Japanese Office Action (and English translation thereof) dated Apr. 15, 2008, issued in a counterpart Japanese Application.

*Primary Examiner*—Stefanos Karmis
*Assistant Examiner*—Howard Sanders
(74) *Attorney, Agent, or Firm*—Holtz, Holtz, Goodman & Chick, PC

(57) ABSTRACT

A sheet storing device capable of storing a plurality of sheets, which feeds a sheet of the stored sheets, includes: a side regulating member which regulates a side portion of the stored sheets that is in parallel with a feeding direction of the sheets; and a side regulating member adjusting unit in which one end side of the side regulating member in the feeding direction serves as a fulcrum, and the other end side of the side regulating member in the feeding direction is capable of being rotated, and an angle of the side regulating member with respect to the feeding direction is capable of being adjusted.

7 Claims, 3 Drawing Sheets

U.S. PATENT DOCUMENTS

| | | | | |
|---|---|---|---|---|
| 6,955,350 | B2 * | 10/2005 | Hashiguchi et al. | 271/255 |
| 2006/0049575 | A1 * | 3/2006 | Funk et al. | 271/207 |
| 2007/0052163 | A1 * | 3/2007 | Sasaki et al. | 271/238 |
| 2008/0088081 | A1 * | 4/2008 | Miwa et al. | 271/210 |
| 2010/0133743 | A1 * | 6/2010 | Hamasaki et al. | 271/241 |

FOREIGN PATENT DOCUMENTS

| | | | | |
|---|---|---|---|---|
| JP | 2005-053645 | A | | 3/2005 |
| JP | 2005-60064 | A | | 3/2005 |
| JP | 2005262458 | A | * | 9/2005 |
| JP | 2005263458 | A | * | 9/2005 |

* cited by examiner

BEFORE ADJUSTMENT

AFTER ADJUSTMENT

SHEET STORING DEVICE AND IMAGE FORMING APPARATUS PROVIDED THEREWITH

This application is based on Japanese Patent Application No. 2006-168450 filed on Jun. 19, 2006, which is hereby incorporated by reference.

BACKGROUND OF THE INVENTION

The present invention relates to a sheet storing device capable of storing a plurality of sheets and feeding out stored sheets, and to an image forming apparatus provided with the sheet storing device.

There is known recently that a finisher is connected to an image forming apparatus of an electrophotographic type to create a shortrun-printing machine in which a booklet is made by printing on the obverse and the reverse of a sheet and by bounding sheets in order of pages. In the case of making a booklet in this way, highly accurate registering between a sheet and an image is needed. For example, when binding a booklet and spreading its pages after printing on the obverse and the reverse of a sheet, if images on the obverse and the reverse are poorly registered, the bookbinding is poor in quality. When cutting sheet edges after a plurality of sheets are bound, if an image is not formed at a correct position on a sheet, there is a danger of an accident that a part of an image is cut to be missing.

In the image forming apparatus of this kind, it is required that an image is formed at a correct position on a sheet, and in a sheet storing device in the image forming apparatus, it is necessary to store sheets at an appropriate position by using a sheet regulating member. If sheets are stored at an appropriate position, a sheet can be fed out of the sheet storing device without skewing and bias, whereby, an image is formed at a correct position on the sheet.

With respect to a sheet regulating member in a sheet storing device, it is described in Unexamined Japanese Patent Application Publication No. 2005-60064. In the sheet storing device described in Japanese Patent Application Publication No. 2005-60064, there are provided a leading edge regulating member that regulates a position of a leading edge in the sheet feeding direction of a sheet, a pair of side regulating members that regulate positions of both sides of the sheet in the direction perpendicular to the sheet feeding direction and a trailing edge regulating member that regulates a position of a trailing edge of a sheet in the sheet feeding direction.

However, even when a position of a sheet is tried to be regulated by the leading edge regulating member described in Unexamined Japanese Patent Application Publication No. 2005-60064, there is occasionally the case that a gap is caused between a sheet and the leading edge regulating member, by degrees of precision of parts in the leading edge regulating member and by bending in the sheet storing device, which makes it impossible to regulate a sheet at a correct position.

SUMMARY OF THE INVENTION

An aspect of the invention can be attained by the following structures.

Structure 1: A sheet storing device capable of storing a plurality of sheets and of feeding out the stored sheets, having therein a side regulating member that regulates a side of the sheet that is in parallel with a feeding direction of the sheet stored in the sheet storing device, and a side regulating member adjusting unit wherein one side of the side regulating member in the aforesaid feeding direction serves as a fulcrum, and the other side of the side regulating member is made to be capable of being rotating, and an angle for the feeding direction of the side regulating member can be adjusted.

Structure 2: An image forming apparatus having the sheet storing device in Structure 1 and an image forming section that forms an image on a sheet fed out of the sheet storing device.

Figure 3:
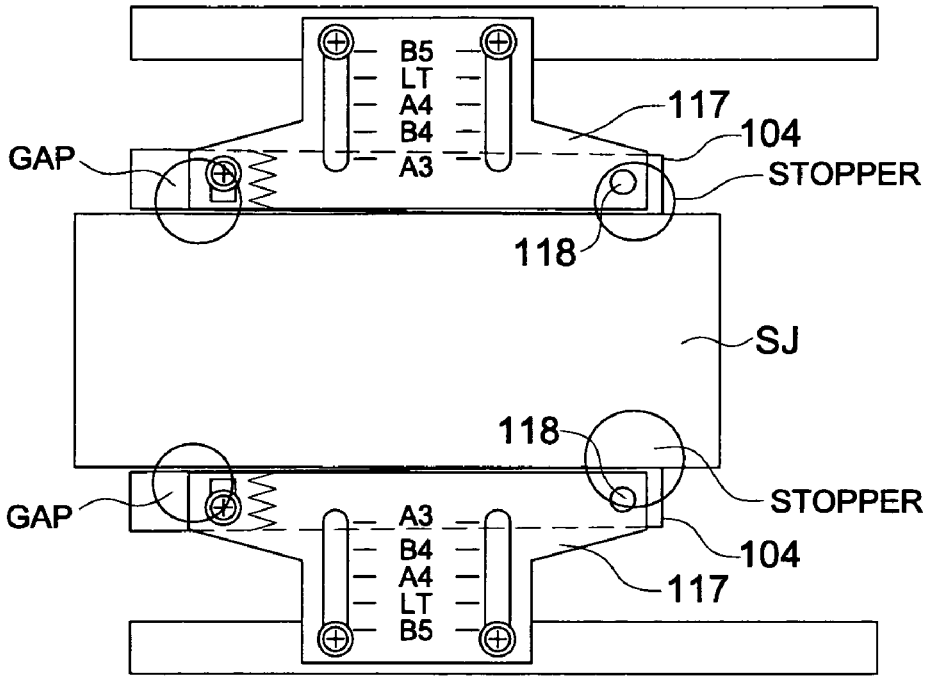
Figure 3:
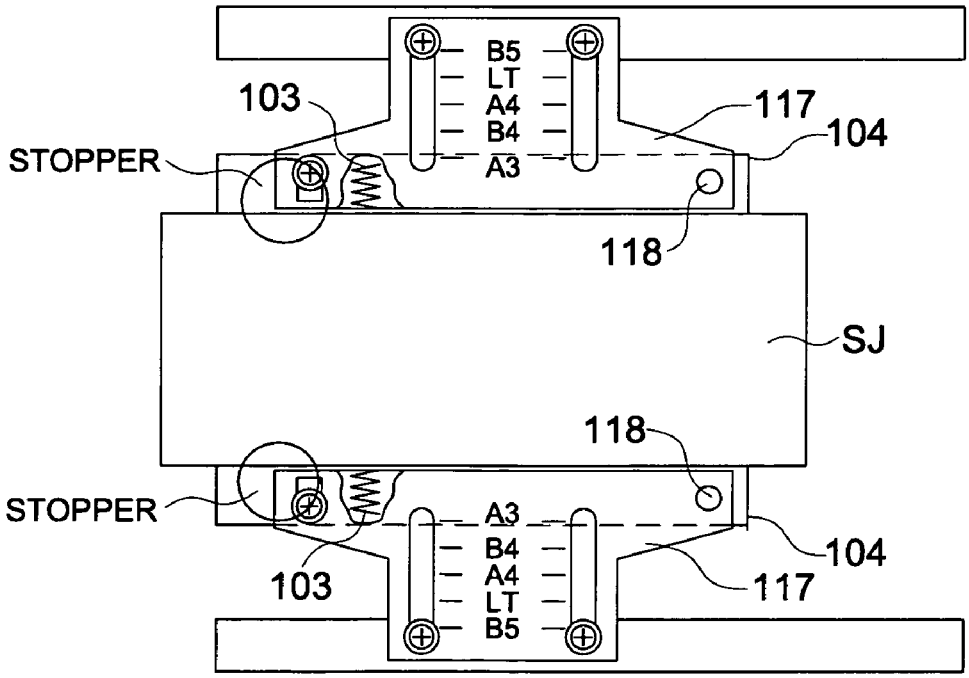

Each of FIGS. 3(*a*) and 3(*b*) is a diagram showing how to adjust by using adjusting jig SJ.

DETAILED DESCRIPTION OF THE PREFERRED EMBODIMENT

An example of the embodiment of the invention will be explained as follows, referring to the drawings. Incidentally, the description in the present column does not limit the technical scope and meanings of terminologies in the claims. Further, with respect to directions of X, Y and Z illustrated in FIGS. 1 and 2, X direction represents a direction toward the left side when the image forming apparatus of the present embodiment is observed from the front, and the opposite X direction represents a direction toward the right side. Further, Y direction represents an upward direction when the image forming apparatus is observed from the front, and the opposite Y direction represents a downward direction. Further, Z direction represents a backward direction when the image forming apparatus is observed from the front, and the opposite Z direction represents a direction toward this side.

<Image Forming Apparatus>

Figure 1:
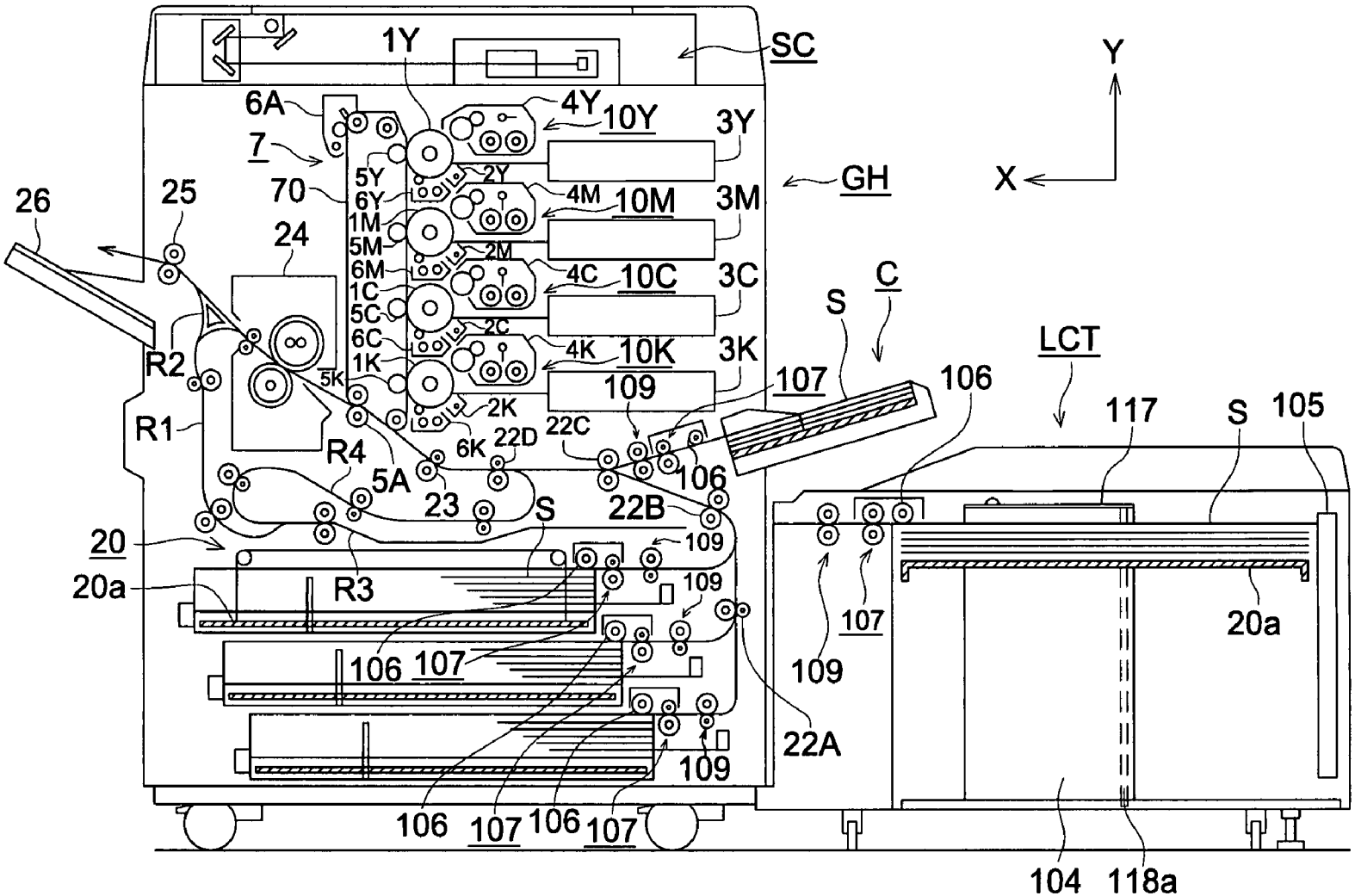
FIG. 1 is a schematic sectional view of an image forming apparatus relating to the invention.

FIG. 1 is a cross-sectional and structural diagram of a sheet storing-device and an image forming apparatus provided with the sheet storing device which show an example of the embodiment of the invention. This image forming apparatus is one called a tandem type color image forming apparatus which is composed of a plurality sets of image forming sections 10Y, 10M, 10C and 10K representing an image forming unit, fixing unit 24, sheet storing device and its sheet feeding and conveying member. Document image reading device SC is arranged on the top of image forming apparatus main body GH, large capacity sheet storing device LCT is arranged on the right side of the image forming apparatus main body GH on a page of the drawing, and a sheet is fed from the large capacity sheet storing device LCT to the image forming apparatus main body GH, for image forming. A sheet can be fed from LCT and from sheet-feeding cassette 20 or from manual sheet-feeding tray C.

Image forming section 10Y that forms an image in a yellow color has therein charger 2Y arranged around photoconductor drum 1Y representing the first image carrier, exposing unit 3Y, developing unit 4Y, primary transfer roller 5Y representing the first transfer unit and cleaning unit 6Y. Further, image forming section 10M that forms an image in a magenta color has therein photoconductor drum 1M representing the first image carrier, charger 2M, exposing unit 3M, developing unit 4M, primary transfer roller 5M representing the first transfer unit and cleaning unit 6M. Furthermore, image forming section 10C that forms an image in a cyanic color has therein photoconductor drum 1C representing the first image carrier, charger 2C, exposing unit 3C, developing unit 4C, primary transfer roller 5C representing the first transfer unit and cleaning unit 6C. Furthermore, image forming section 10K that forms an image in a black color has therein photoconductor drum 1K representing the first image carrier, charger 2K, exposing unit 3K, developing unit 4K, primary transfer roller 5K representing the first transfer unit and cleaning unit 6K.

Intermediate transfer unit 7 has intermediate transfer member 70 representing a semi-conductive endless-belt-shaped second image carrier that is trained about plural rollers to be supported rotatably.

Images each having a different color formed respectively by image forming sections 10Y, 10M, 10C and 10K are transferred in order on rotating intermediate transfer member 70 by primary transfer rollers 5Y, 5M, 5C and 5K, whereby, a composite color image is formed. Sheet S placed on any one of sheet-feeding cassette 20 representing a sheet placing unit, manual sheet-feeding tray C and large capacity sheet storing device LCT is fed one by one by sheet-feeding roller 106 representing a sheet feeding member and by separation upper roller 107*b*, and the leading edge of the sheet S hits registration roller 23 representing a second registration member, through preliminary registration roller 109 representing a first registration member and through plural intermediate rollers 22A, 22B, 22C and 22D representing a sheet feeding and conveying member.

After that, a rotation of registration roller 23 is started in synchronization with image forming in image forming sections 10Y, 10M, 10C and 10K and intermediate transfer unit 7, whereby, the sheet S is conveyed to secondary transfer roller 5A representing a transfer unit, thus color images are transferred collectively on the sheet S. The sheet S on which the color images have been transferred is subjected to fixing processing by fixing unit 24, and is interposed between sheet-ejection rollers 25 to be placed on sheet-ejection tray 26 located outside the apparatus.

On the other hand, after the color images have been transferred onto the sheet S by the secondary transfer member 5A, the intermediate transfer member 70 from which the sheet S has been curvature-separated is cleaned by cleaning unit 6A to be free from residual toner. The residual toner is collected in a box by an unillustrated device.

In the course of image forming processing, primary transfer roller 5K is in pressure contact with photoconductor drum 1K constantly through intermediate transfer member 70. Other primary transfer rollers 5Y, 5M and 5C come in pressure contact respectively with corresponding photoconductor drums 1Y, 1M and 1C only in the course of color image forming only, through the intermediate transfer member 70. Secondary transfer unit 5A is brought into pressure contact with the intermediate transfer member 70, only when the sheet S passes through the secondary transfer unit and secondary transfer is carried out.

<Sheet Storing Device>

Figure 2:
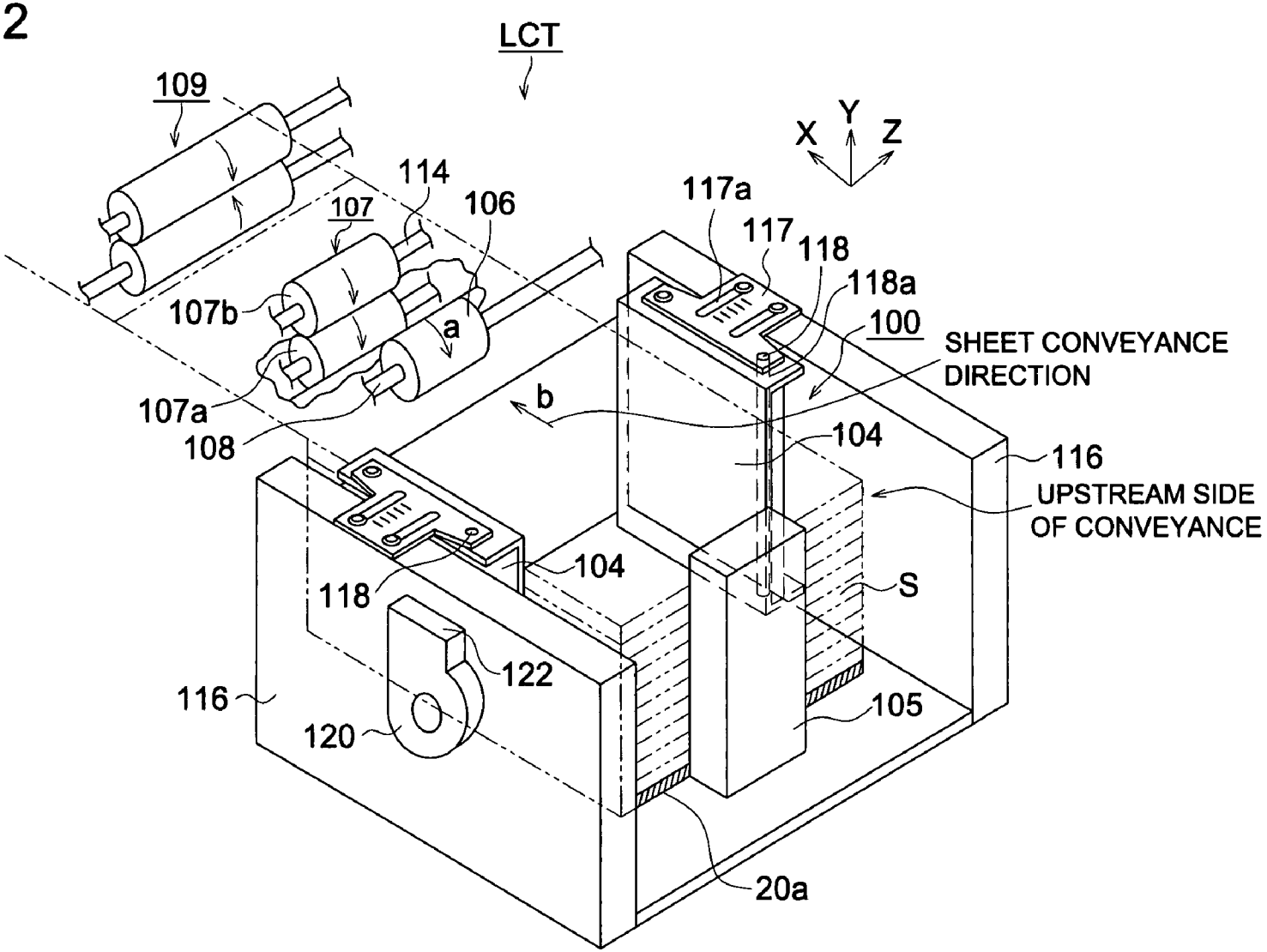
FIG. 2 is a perspective view showing the main part under the sate where a cover of large capacity sheet storing device LCT is removed.

Next, details of a sheet conveyance unit used in the image forming apparatus shown in FIG. 1 will be explained, referring to an example of large capacity sheet storing device LCT. FIG. 2 is a perspective view showing primary portions where a cover of the large capacity sheet storing device LCT is removed.

In FIG. 2, piled sheets S are stacked on elevating table 20*a* that is a sheet placing stand to be supported movably up and down by an unillustrated mechanism for going up and down. Side regulating members 104 representing sheet edge regulating members can move freely in the direction perpendicular to the sheet S conveyance direction (illustrated X direction), namely, in the width direction (illustrated Z direction and opposite Z direction) in the present embodiment, to come into contact with both sides of stacked sheets S for regulating both sides of sheets S. Rear edge regulating member 105 can move freely in the direction (illustrated X direction and opposite X direction) that is in parallel with a conveyance direction for sheet S, and it regulates a position of the trailing edge of sheet S in its conveyance direction, and it also functions as a sheet edge regulating member. On the leading edge of sheet S in its conveyance direction, there is provided sheet-feeding roller 106 representing a member to feed out a sheet which is in pressure contact with uppermost sheet S under an appropriate force.

When the sheet-feeding roller 106 is driven by an unillustrated driving member to rotate in the direction of arrow "a", the uppermost sheet S advances in the direction of arrow "b" to touch separation lower roller 107*a* representing a sheet separating member that lies adjacent to the exit side of the sheet-feeding roller 106. When double feeding is caused, separation lower roller 107*a* that is driven by an unillustrated driving member to rotate in the direction identical to that of arrow a pushes back the second sheet immediately below the uppermost sheet and thereafter, and the uppermost one sheet only is conveyed by separation upper roller 107*b* that is driven by an unillustrated driving member to rotate in the direction of an arrow. Incidentally, separation roller 107 is constituted by a pair of separation lower roller 107*a* and separation upper roller 107*b*.

A leading edge of the sheet S conveyed by the separation upper roller 107*b* hits preliminary registration roller 109. The preliminary registration roller 109 is composed of a pair of rollers facing each other, and is provided on a conveyance path for sheet S in a way that the rollers may be rotated by an unillustrated driving member in the direction indicated by an arrow. The sheet S which has hit the preliminary registration roller 109 once is conveyed to image forming apparatus main body GH by the preliminary registration roller 109 that rotates in synchronization with sheet-feeding timing.

Side regulating member adjusting unit 100 will be explained here. The side regulating member adjusting unit 100 is provided with side adjusting plate 117 that is fixed by screws, on side surface 116 of a casing for large capacity sheet storing device LCT and with side regulating member 104.

The side adjusting plate 117 that is fixed on side surface 116 of a casing for large capacity sheet storing device LCT is provided with elongated hole 117*a* and a scale that is located in the vicinity of the elongated hole and indicates a sheet size, and the side adjusting plate can be fixed by screws in accordance with a sheet size. Further, the side adjusting plate 117 is arranged so that side regulating member 104 capable of swiveling around fulcrum 118 may be mounted thereon. Meanwhile, in the present example, fulcrum pivot 118*a* is provided on fulcrum 118 so that the fulcrum pivot may extend to the bottom plate of large capacity sheet storing device LCT, for supporting the side regulating member 104. However, a fulcrum that is split into an upper portion and a lower portion can also be used. Further, on the upper portion at the downstream side in the direction for feeding out the sheet, there is provided urging member 103 composed of a compression spring and others, so that both sides of a sheet may be urged constantly by the side regulating member 104. Specifically, the urging member 103 is provided at the position that is about 30 mm downward from the upper end portion of the side regulating member 104 and is about 50 mm from the tip portion of the downstream side in the direction of feeding out a sheet, and it urges with a force of about 100 N-200 N.

Each of FIGS. 3(*a*) and 3(*b*) shows how to adjust by using adjusting jig SJ in the course of production, product inspection or product installation. FIG. 3(*a*) is a diagram wherein the adjusting jig SJ is placed on elevating table 20*a* to be lifted up to the position of sheet-feeding roller 106. The side adjusting plate 117 is adjusted to be fixed by screws so that the side regulating member 104 located on the fulcrum 118 side may hit the adjusting jig SJ. Next, as shown in FIG. 3(*b*), the side regulating member 104 is caused by urging member 103 to make contact with the adjusting jig SJ, and is fixed by screws under the condition of no gap. By adjusting at the position to which the elevating table 20*a* is lifted in accordance with a height of the sheet-feeding roller 106 that feeds a sheet actually, it is possible to enhance accuracy of regulating position at the actual sheet-feeding position. Incidentally, the perpendicularity tolerance of each corner of the adjusting jig SJ is not more than 0.05 mm.

By providing the side regulating member adjusting unit 100 having the side regulating member 104 of this kind, the present structure has made it possible to adjust to ±0.1 mm from the conventional errors of ±0.5 mm in the sheet width direction (Z direction) for the design standard.

Since an image forming apparatus equipped with large capacity sheet storing device LCT is generally voluminous and massive, flatness and strength of a floor face are greatly influential. For example, if the flatness of the floor is poor (odd-shaped), a frame of the main body of the apparatus follows the poor-flatness and is distorted. Though a height adjusting member is attached on the main body of the apparatus as measures for this distortion, sheet conveyance accuracy is badly affected even when a distortion of a large capacity sheet storing device is small. Therefore, large capacity sheet storing device LCT of the invention is characterized to be capable of adjusting, so that an error of sheet width direction (Z direction) for the design standard may be within ±0.1 mm, by using again adjusting jig SJ after installing the apparatus and fixing it with a height adjusting member. Incidentally, the adjusting jig SJ may either be furnished to the apparatus, or be carried by a serviceman. Further, although the present example is structured so that the upstream side in the direction to feed out a sheet is fulcrum 118, and the downstream side is rotatable, it is also possible to structure to be opposite to the foregoing.

<Separating Fan>

As a sheet separator, small-sized fan 120 is provided on the large capacity sheet storing device LCT, in a way to feed out air to air-blowing outlet 122 (see FIG. 2). Air fed out upward from the fan 120 is changed by 90° in terms of its direction by an unillustrated fan mounting plate to be blow out horizontally. The air-blowing outlet 122 is opened near the upper end of the side regulating members 104, and its outlet is lattice-shaped to prevent that the fan 120 is damaged by foreign substances. Further, the air-blowing outlet 122 is provided with a shutter mechanism (not shown) that regulates a position of an aperture of the air-blowing outlet 122 while following the uppermost surface of sheets, whereby, excessive lifting of sheet S is controlled, and a positional relationship between a position of an aperture of the air-blowing outlet and the uppermost surface of sheet S is kept to be constant.

When the fan 120 rotates, air is forwarded from the air-blowing outlet 122 to blow against several sheets located at the upper portion of stacked sheets S. Air flows through gaps between several sheets positioned at the upper portion of sheets S from one side thereof. Owing to this, adhesion strength between sheets is reduced, and upper several sheets in sheets S are separated into pieces. An uppermost sheet among sheets S thus separated is taken out by the sheet-feeding roller 106 to be fed into the image forming section.

Constructions and functions of the sheet-feeding roller 106 that feeds a sheet loaded on cassette 20 provided on image forming apparatus main body GH or on manual sheet-feeding tray C, separation roller 107 and preliminary registration roller 109 are the same as those of the members which are given the same symbols as in the large capacity sheet storing device LCT. However, one-sided sheet sensor 115 is not provided, and corrections for skewing and one-sided sheet S for positions of image forming by the image forming unit are carried out by unillustrated positioning members.

That is, an image on the sheet that is fed from LCT can respond to a high image quality mode in which an image is printed more accurately at the fixed position from an edge of the sheet, while, an image on the sheet that is fed from cassette 20 or from manual sheet-feeding tray C is for an ordinary image mode that is slightly inferior to LCT in terms of accuracy of a position from an edge of the sheet.

In the invention, side regulating member adjusting unit 100 is provided on large capacity sheet storing device LCT and side regulating member 104 capable of rotating is further provided as explained above, whereby, an angle in the sheet width direction can be adjusted at the location nearest to sheet-feeding roller 106, thus, an image printed by an image forming apparatus on a sheet fed and conveyed is free from displacement, resulting in preparation of booklets which have been bound to be of high quality.

What is claimed is:

1. A sheet storing device which is capable of storing a plurality of sheets, and which feeds a sheet of the stored sheets, comprising:

(a) a first side regulating member which has a flat surface having a length extending between a first end side of the first side regulating member and a second end side of the first side regulating member along a feeding direction of the sheets, and which regulates a first side portion of the stored sheets by bringing substantially an entirety of the length of the flat surface from the first end side to the second end side into contact with the first side portion of the stored sheets;

(b) a second side regulating member which has a flat surface having a length extending between a first end side of the second side regulating member and a second end side of the second side regulating member along a feeding direction of the sheets, and which regulates a second side portion of the stored sheets by bringing substantially an entirety of the length of the flat surface from the first end side to the second end side into contact with the second side portion of the stored sheets, wherein the first and second side regulating members interpose the sheets stored in the sheet storing device therebetween and face each other, and wherein each of the first side regulating member and the second side regulating member, including the first end side and the second end side, is movable in a width direction of the stored sheets in accordance with a sheet size thereof, (c) a first side regulating member adjusting unit which adjusts an angle of the first side regulating member with respect to the feeding direction, and fixes the first side regulating member at the adjusted angle; and (d) a second side regulating member adjusting unit which adjusts an angle of the second side regulating member with respect to the feeding direction, and fixes the second side regulating member at the adjusted angle, wherein the fed sheet of the stored sheets is fed with the first side regulating member and the second side regulating member fixed at the respective adjusted angles, and wherein the first end side of each of the first side regulating member and the second side regulating member serves as a fulcrum, and the second end side of the each of the first side regulating member and the second side regulating member is rotatable about the fulcrum.

2. The sheet storing device of claim 1, wherein the first end side of each of the first side regulating member and the second side regulating member is located at a position upstream of the second end side thereof with respect to the feeding direction.

3. The sheet storing device of claim 1, further comprising an urging member which urges the second end side of each of the first side regulating member and the second side regulating member.

4. The sheet storing device of claim 1, wherein each of the first side regulating member and the second side regulating member is movable in a direction perpendicular to the sheet feeding direction according to a width of the sheets.

5. The sheet storing device of claim 1, wherein each of the first side regulating member adjusting unit and the second side regulating member adjusting unit comprises a side adjusting plate which is screwed on a side surface of a frame of the sheet storing device through an elongated hole, and wherein each of the first side regulating member and the second side regulating member is mounted on the side adjusting plate.

6. An image forming apparatus comprising:

(a) the sheet storing device of claim 1; and (b) an image forming section which forms an image on the sheet fed from the sheet storing device.

7. The sheet storing device of claim 1, wherein each of the first side regulating member adjusting unit and the second side regulating member adjusting unit comprises a fulcrum pivot provided to correspond to the fulcrum at the first end side of the first and second side regulating members such that the fulcrum pivot passes through the first and second side regulating member members over an entire range in a height direction thereof to provide support thereto.

* * * * *